US008558128B2

(12) United States Patent
Takai

(10) Patent No.: US 8,558,128 B2
(45) Date of Patent: Oct. 15, 2013

(54) SWITCH DEVICE

(75) Inventor: Toshihito Takai, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 223 days.

(21) Appl. No.: 13/161,067

(22) Filed: Jun. 15, 2011

(65) Prior Publication Data

US 2011/0315532 A1 Dec. 29, 2011

(30) Foreign Application Priority Data

Jun. 24, 2010 (JP) ..... P.2010-143643

(51) Int. Cl.
*H01H 1/64* (2006.01)

(52) U.S. Cl.
USPC ..... 200/293; 200/302.2

(58) Field of Classification Search
USPC ..... 200/293–296, 303, 524
See application file for complete search history.

(56) References Cited

U.S. PATENT DOCUMENTS 3,629,526 A * 12/1971 Lewis ..... 200/16 C
4,239,947 A * 12/1980 Breitung et al. ..... 200/61.89
4,387,818 A * 6/1983 Conti ..... 215/256
4,467,159 A * 8/1984 Ota et al. ..... 200/524
5,508,479 A * 4/1996 Schooley ..... 200/5 R
6,018,131 A * 1/2000 Snider ..... 200/301
6,877,798 B2 * 4/2005 Nakajima et al. ..... 296/210
6,960,734 B1 * 11/2005 Park ..... 200/343
7,164,092 B2 * 1/2007 Kawano ..... 200/310

* cited by examiner

*Primary Examiner* — Xuong Chung Trans
(74) *Attorney, Agent, or Firm* — Morgan, Lewis & Bockius LLP

(57) ABSTRACT

A switch device includes a body, an insulator which forms an outer casing with the body, a first engagement portion formed at a side portion of the body, a flange portion formed at an edge part of the side portion of the body, a second engagement portion formed on the insulator so as to be engaged with the first engagement portion, and a pressing portion which is formed on the insulator and is adapted to press the flange portion in a state that a plane part of the pressing portion is in line-contact with the edge part of the flange portion when the first engagement portion is engaged with the second engagement portion. The edge part of the flange portion is in intimate contact with the pressing portion by a restoring force of the flange portion under a condition that the flange portion is pressed by the pressing portion, and the flange portion urges the second engagement portion engaged with the first engagement portion in a restoring direction of the flange portion so as to reinforce the engagement of the first engagement portion with the second engagement portion.

5 Claims, 8 Drawing Sheets

PRIOR ART

SWITCH DEVICE

TECHNICAL FIELD

The present invention relates to a switch device having an outer casing formed of a body and an insulator.

BACKGROUND

In the recent years, regarding a switch device to be built in an instrument panel of, for example, a vehicle such as an automobile, a switch device having an outer casing 1 formed of a body 2 and an insulator 3 as shown in FIG. 7 has been provided as a related art.

In this case, the body 2 is formed of a rectangular shaped box having a side face portion and a rear face portion which are opened as shown in FIG. 7. Also, the body 2 has an operation button 4 on a front face portion thereof. In an inner section (not shown) of the body 2, a contact holder which is moved by pushing of the operation button 4, a movable contact attached to the contact holder, a restoring spring for applying a restoring force to the contact holder and a holding mechanism such as a so-called heart cam mechanism or the like which holds the contact holder at a position before movement or a position after movement are arranged. In this case, a plurality of engagement holes 5 (two holes in the example shown in FIG. 7) are formed at upper and lower side portions of the body 2, respectively.

On the other hand, the insulator 3 is of a rectangular shaped plate and has a fixed contact (not shown) at a body 2 side and a plurality of connection terminals 6 at a rear side in the innermost area. In this case, engagement pawls 7 of which the number is the same as that of the engagement holes 5, are respectively formed at upper and lower side portions of the insulator 3.

With the above configuration, the insulator 3 is pushed into the side face portion at the right side of the body 2 as shown in FIG. 8 and the engagement pawls 7 are engaged with the engagement holes 5 so as to cause the insulator 3 to be coupled to the body 2, thereby, the outer casing 1 is assembled.

When the operation button 4 is operated to be pushed from the front side in this assembled condition of the insulator 3 and the body 2, the contact holder is moved toward the innermost area against an urging force of the restoring spring so as to bring the movable contact into contact with the fixed contact. At that time, the holding mechanism holds the contact holder at a position after the movement, thereby the operation button 4 is held at a position after the pushing and the movable contact is held at a position where it is in contact with the fixed contact.

Next, when the operation button 4 is operated so as to be pushed again, the holding mechanism releases the holding of the contact holder and the contact holder is moved to a restored condition, thereby the movable contact is restored to a position away from the fixed contact and the operation button 4 is restored to the initial position before the pushing. Meanwhile, the above related switch device is general, but a prior art document representing a switch device shown in FIG. 7 is not found.

In such a related switch device, in the assemble condition of the outer casing 1, a gap for putting the insulator 3 into the body 2 is unavoidably needed at portions between edge parts of upper and lower side portions of the body 2 and upper and lower side portions of the insulator 3. Therefore, when water is poured down onto the outer casing 1 having the above components, the water may enter the inside of the outer casing 1 through the gap so that a trouble such as a short circuit of the fixed contact due to the water may occur.

SUMMARY

The invention is made in view of the above circumstances, and the purpose of the invention is to provide a switch device which is excellent in a waterproof property and has an outer casing with a high structural precision.

In order to achieve the above object, according to the present invention, there is provided a switch device, comprising:

a body;

an insulator which forms an outer casing with the body;

a first engagement portion which is formed at a side portion of the body;

a flange portion which is formed at an edge part of the side portion of the body;

a second engagement portion which is formed on the insulator so as to be engaged with the first engagement portion; and a pressing portion which is formed on the insulator and is adapted to press the flange portion in a state that a plane part of the pressing portion is in line-contact with the edge part of the flange portion when the first engagement portion is engaged with the second engagement portion, wherein the edge part of the flange portion is in intimate contact with the pressing portion by a restoring force of the flange portion under a condition that the flange portion is pressed by the pressing portion, and the flange portion urges the second engagement portion engaged with the first engagement portion in a restoring direction of the flange portion so as to reinforce the engagement of the first engagement portion with the second engagement portion.

Preferably, the first engagement portion has a recess part which is not opened to the outside of the body.

Here, it is preferable that, the second engagement portion has an engagement pawl, and the engagement pawl is engaged with the recessed part.

Preferably, the first engagement portion has an engagement pawl and the second engagement portion has a recessed part, and the engagement pawl is engaged with the recessed part.

With the above configurations, when the first engagement portion of the body is engaged with the second engagement portion of the insulator, the pressing portion of the insulator presses the flange portion of the body in such a manner that the plane part of the pressing portion is in contact with the edge part of the flange portion under the line contact condition, and thereby the edge part of the flange portion is intimate contact with the pressing portion by the restoring force under the pressing condition. Accordingly, an excellent waterproof property can be achieved. Since the flange portion urges the second engagement portion engaged with the first engagement portion in the restoring direction of the flange portion so as to reinforce the engagement therebetween, the structural precision of the outer casing can be enhanced.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF EXEMPLARY EMBODIMENTS

Figure 1:
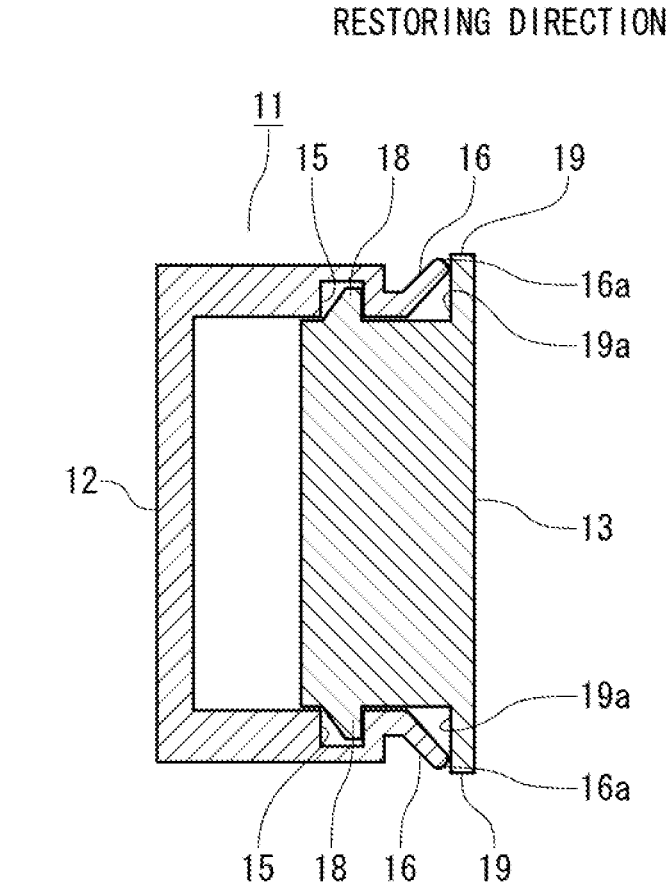
FIG. 1 is a cross sectional view showing a switch device taken along line I-I in FIG. 4 according to a first embodiment of the invention.
Figure 2:
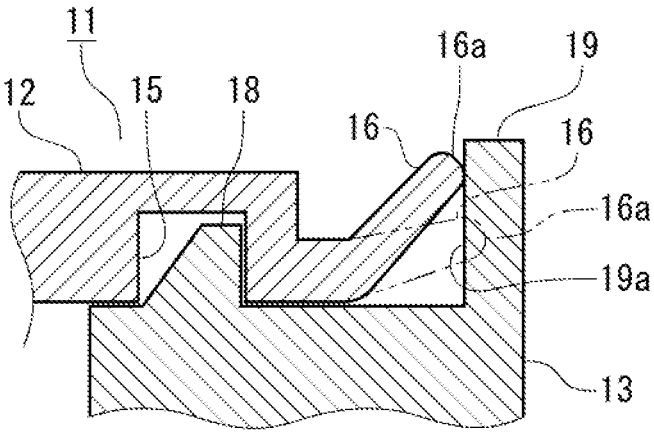
FIG. 2 is an enlarged sectional view of a main part of the switch device.
Figure 3:
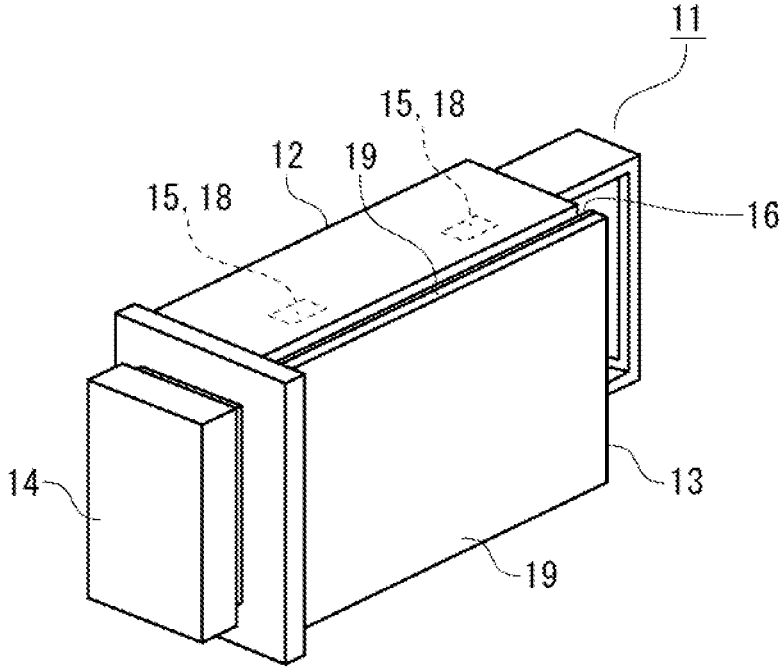
FIG. 3 is an appearance perspective view of an entirety of the switch device.
Figure 4:
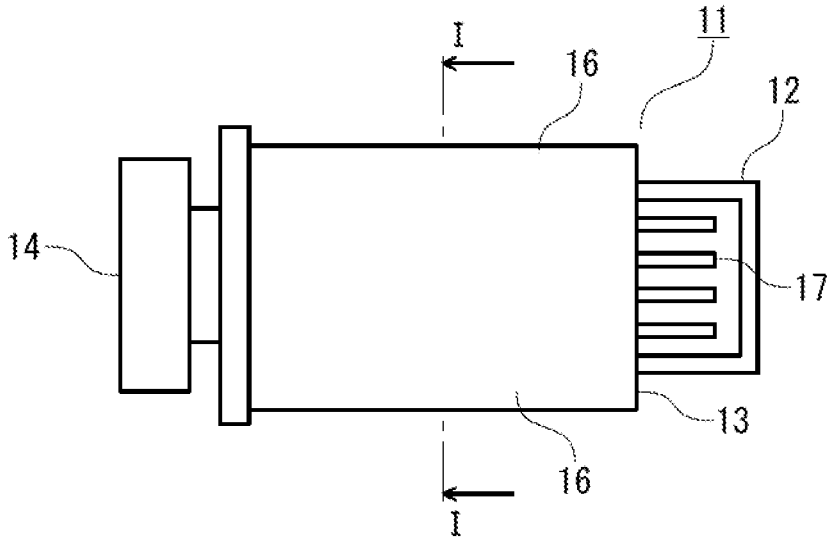
FIG. 4 is a side elevational view of the entirety of the switch device.
Figure 5:
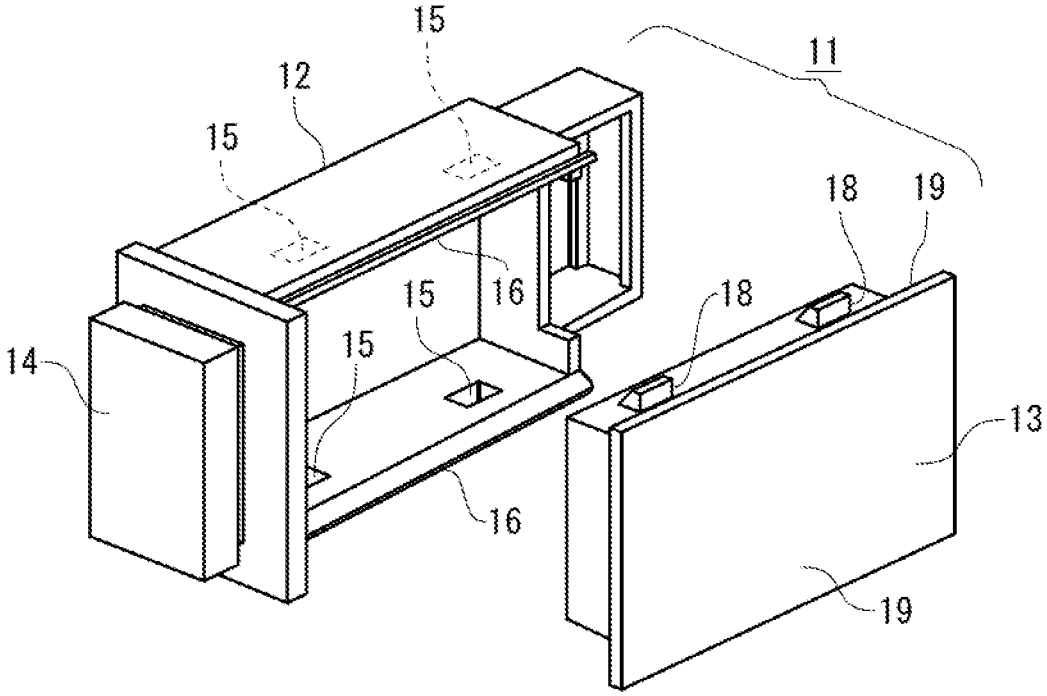
FIG. 5 is an exploded view of the entirety of the switch device.

A switch device according to a first embodiment of the invention is described below with reference to FIGS. 1 to 5. FIGS. 3 to 5 show an entire structure of the switch device having an outer casing 11 which is formed of a body 12 and an insulator 13. The body 2 is made of a plastic material such as an ABS resin, is formed of a rectangular shaped box having a side face portion at a right side and a rear face portion in an innermost area which are opened as shown in FIG. 5. Also, the body 2 has an operation button 14 on a front face portion at a front side. In an inner section (not shown) of the body 12, a contact holder which is moved by pushing of the operation button 14, a movable contact attached to the contact holder, a restoring spring for applying a restoring force to the contact holder and a holding mechanism such as a so-called heart cam mechanism or the like which holds the contact holder at a position before movement or a position after movement are arranged.

In this case, a plurality of engagement recessed portions 15 (two recessed portions in the example shown in FIG. 5) as first engagement portions are formed at upper and lower side portions of the body 12, respectively. The engagement recessed portions 15 are formed at the inner sides of the upper and lower side portions of the body 12 by a molding process by using a slide core. The engagement recessed portions 15 are not opened to the outside as shown in FIGS. 1 and 2.

In addition, in this case, flange portions 16 are formed on respective edge parts of the upper and lower side portions of the body 12 at an insulator 13 side over the respective whole lengths. To be more detailed, as a normal state is shown in FIG. 2 by a double-dashed line, the flange portions 16 extend straight from the respective inner sides of the edge parts of the upper and lower side portions of the body 12 at the insulator 13 side to their rear sides, and further extend diagonally outward from the tip portions. The thickness of each of the flange portions is made smaller than that of each of the upper and lower side portions of the body 12.

On the other hand, the insulator 13 is formed of a rectangular shaped plate and has a fixed contact (not shown) at a body 2 side and a plurality of connection terminals 17 (not shown) at a rear side in the innermost area. In this case, engagement pawls 18 of which the number is the same as that of the engagement recessed portions 15 as second engagement portions, are respectively formed at the upper and lower side portions of the insulator 13 at the body 2 side.

In this case, a pressing portion 19 is formed on each of the upper and lower side portions at its outer edge part (at the opposite side of the body 2 side) of the insulator 13 over the whole length thereof. The pressing portions 19 are formed so as to straightly protrude from the respective edge parts of the upper and lower side portions of the insulator 13 toward the respective upper and lower sides, and have respective flat plane parts 19*a* at the body 2 side.

In the above configuration, the insulator 13 is pressed into the open part at the side face portion of the body 12 as shown in FIG. 1, and the engagement pawls 18 are engaged with the engagement recessed portions 15 to fit the insulator 13 into the body 12. At that time, the pressing portions 19 of the insulator 13 press the flange portions 16 in a state that the plane parts 19*a* are in contact with the respective edge parts 16*a* of the flange portions 16 of the body 12 under a line contact condition. Each of the pressed flange portions 16 is deformed to be in a state indicated by a solid line from a state indicated by a double-dashed line as shown in FIG. 2. The edge parts 16*a* of the flange portions 16 are in intimate contact with the respective plane parts 19*a* of the pressing portions 19 by the restoring force from the above state, and urge the respective engagement pawls 18 engaged with the engagement recessed portions 15 in a restoring direction of the flange portions 16 (in the outer direction in this case) so as to reinforce the engagement between the engagement pawls 18 and the engagement recessed portions 15.

Thus, the outer casing 11 of the switch device is assembled. In the assembled condition, since the edge parts 16*a* of the flange portions 16 pressed by the respective pressing portions 19 of the insulator 13 are in intimate contact with the respective plane parts 19*a* of the pressing portions 19 by the restoring force under the line contact condition, it is possible to achieve an excellent waterproof property. Consequently, even when water is poured down onto the outer casing 11, the water does not enter the inner section of the outer casing 11 so that it is possible to eliminate occurrence of a trouble such as a short circuit of the fixed contact due to the water.

In addition, in the above case, since the flange portions 16 urge the respective engagement pawls 18 which are engaged with the engagement recessed portions 15 in the restoring direction of the flange portions 16 so as to reinforce the engagement between the respective engagement pawls 18 and the engagement recessed portions 15, it is possible to eliminate rattling at the engagement part, to enhance the structural precision of the outer casing 11 and to improve quality of the switch device.

Further, in the above configuration, since the switch device is so constituted that the engagement recessed portions 15 of the body 12 are not opened to the outside, that means, the engagement recessed portions 15 of the body 12 are opened to the inside of the body, it is possible to surely eliminate entering of water into the outer casing 11.

In the assembled condition of the outer casing 11, tip portions of the connection terminals 17 are exposed to an open part of the rear face portion of the body 12 so that the connection terminals 17 can be connected to a connector (not shown). When the operation button 14 is operated to be pushed from the front side in this assembled condition of the outer casing 11, the contact holder in the body 12 is moved toward the innermost area against the urging force of the restoring spring so as to bring the movable contact into contact with the fixed contact. At that time, the holding mechanism holds the contact holder at a position after the movement, thereby the operation button 14 is held at a position after the pushing and the movable contact is held at a position where it is in contact with the fixed contact.

Next, when the operation button 14 is operated so as to be pushed again, the holding mechanism releases the holding of the contact holder and the contact holder is moved to a restored condition, thereby the movable contact is restored to a position away from the fixed contact and the operation button 14 is restored to the initial position before the pushing.

Figure 6:
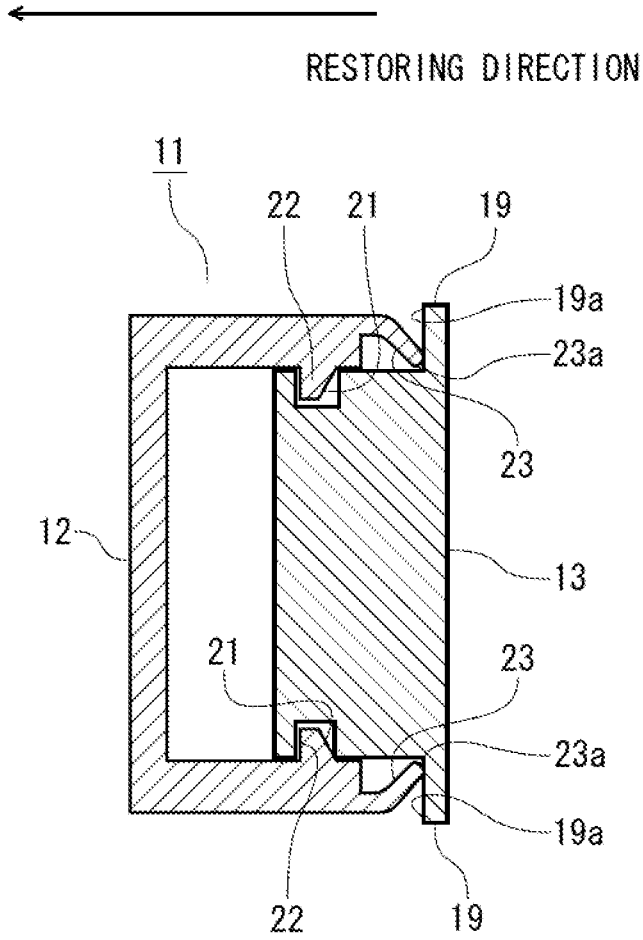
FIG. 6 is a cross sectional view showing a switch device according to a second embodiment of the invention.
Figure 7:
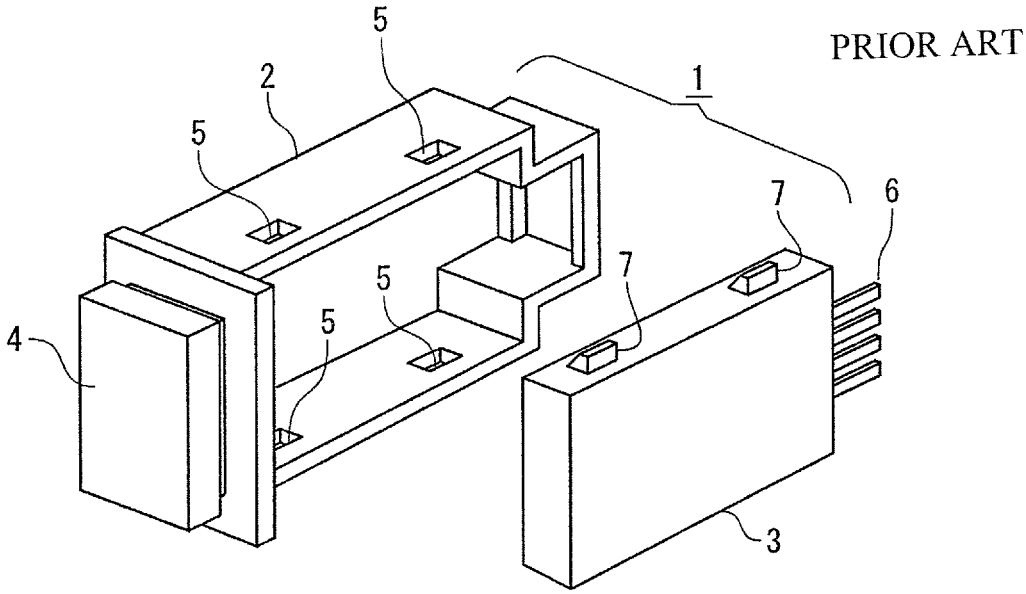
FIG. 7 is an exploded view of the entirety of a related switch device.
Figure 8:
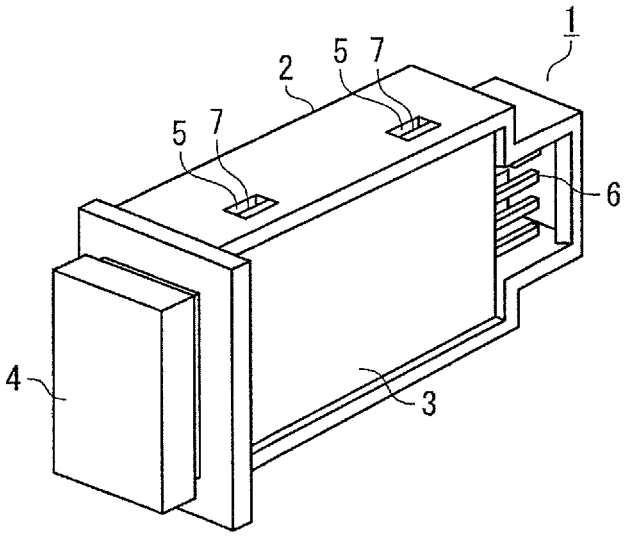
FIG. 8 is an appearance perspective view of the entirety of the related switch device.

Next, FIG. 6 shows a switch device according to a second embodiment of the invention. The parts, portions or members the same as in the above described first embodiment are denoted by the same symbols, their descriptions are omitted, and only different parts, portions or members are described. In this case, engagement pawls 21 are formed on the body 12 instead of the engagement recessed portions 15 and engagement recessed portions 22 are formed on the insulator 13 instead of the engagement pawls 18. Therefore, the first engagement portions of the body 12 can be the engagement recessed portions 15 or the engagement pawls 21, and the second engagement portions of the insulator 13 can be the engagement pawls 18 and the engagement recessed portions 22.

In addition, in this case, the flange portions 23 of the body 12 are so constituted that the tip portions thereof extend diagonally inward in contrast to the flange portions 16. With this configuration, the tip portions are pressed by the respective pressing portions 19 of the insulator 13 and the edge parts 16*a* are caused to be in intimate contact with the respective plane parts 19*a* of the pressing portions 19.

Thus, by a configuration of the second embodiment, it is possible to achieve the advantage similar to the above first embodiment. Further (but not shown), the flange portions 16 and 23 of the body 12 or the pressing portions 19 of the insulator 13 can be formed not only at the respective upper and lower side portions but also at respective front and rear side portions. Moreover, the invention is not limited to the embodiments shown in the drawings, and can be changed or modified within the appended claims without departing from the scope and spirit of the invention.

The present application is based on Japanese Patent Application No. 2010-143643 filed on Jun. 24, 2010, the contents of which are incorporated herein by reference.

What is claimed is:

1. A switch device, comprising:

a body;

an insulator which forms an outer casing with the body;

a first engagement portion which is formed at a side portion of the body;

a flange portion which is formed at an edge part of the side portion of the body;

a second engagement portion which is formed on the insulator so as to be engaged with the first engagement portion; and a pressing portion which is formed on the insulator and is adapted to press the flange portion in a state that a plane part of the pressing portion is in line-contact with the edge part of the flange portion when the first engagement portion is engaged with the second engagement portion, wherein the edge part of the flange portion is in intimate contact with the pressing portion by a restoring force of the flange portion under a condition that the flange portion is pressed by the pressing portion, and the flange portion urges the second engagement portion engaged with the first engagement portion in a restoring direction of the flange portion so as to reinforce the engagement of the first engagement portion with the second engagement portion.

2. The switch device according to claim 1, wherein the first engagement portion has a recess part which is not opened to the outside of the body.

3. The switch device according to claim 2, wherein the second engagement portion has an engagement pawl; and wherein the engagement pawl is engaged with the recessed part.

4. The switch device according to claim 1, wherein the first engagement portion has an engagement pawl and the second engagement portion has a recessed part; and wherein the engagement pawl is engaged with the recessed part.

5. The switch device according to claim 1, wherein the flange portion projects obliquely away from or toward the longitudinal centerline of the body before engaging the pressing portion of the insulator.

* * * * *